US005941254A

United States Patent [19]

Heler

[11] Patent Number: 5,941,254

[45] Date of Patent: Aug. 24, 1999

[54] COSMETICS APPLYING DEVICE

[76] Inventor: Fabián Gustavo Heler, Hipólito Yrigoyen 1495, 1878 Quilmes, Prov. of Bs.As., Argentina

[21] Appl. No.: 09/191,144

[22] Filed: Nov. 13, 1998

[30] Foreign Application Priority Data

Oct. 6, 1998 [AR] Argentina ..... M 98 01 04979

[51] Int. Cl.[6] ..... A45D 33/28

[52] U.S. Cl. ..... 132/297; 132/218; 132/313; 132/320; 15/105; 401/31; 401/34

[58] Field of Search ..... 132/297, 293, 132/294, 300, 313, 301, 304, 317, 318, 216, 218, 320; 15/105, 184; 401/29, 30, 31, 34

[56] References Cited

U.S. PATENT DOCUMENTS

| | | | |
|---|---|---|---|
| 2,458,063 | 1/1949 | Dulberg | 132/317 |
| 2,590,329 | 3/1952 | Kromray | 132/318 |
| 2,829,655 | 4/1958 | Bau | 132/218 |
| 2,902,041 | 9/1959 | Bau | 132/317 |
| 3,181,539 | 5/1965 | Aston | 132/317 |
| 3,592,202 | 7/1971 | Jones | 132/313 |
| 5,056,179 | 10/1991 | Capponi | 15/105 |

*Primary Examiner*—John J. Wilson
*Assistant Examiner*—Pedro Philogene
*Attorney, Agent, or Firm*—Merchant, Gould, Smith, Edell, Welter & Schmidt

[57] ABSTRACT

A multiple pen-like cosmetics applying device comprising a central holder having a first end with a brush for applying wet or dry powder cosmetic and a second end with a lining pencil removably mounted in the second end, whereby the pencil is capable of being moved between an operative position with a marking tip of the pencil being exposed for use and an inoperative position with the tip being housed in a cavity of the holder.

20 Claims, 2 Drawing Sheets

COSMETICS APPLYING DEVICE

BACKGROUND OF THE INVENTION

1. Field of the Invention

The present invention relates to a cosmetics applying device of the type including a plurality of applicators and cosmetics to be applied in the eyes, the lashes, the lips and the face, for example.

To the purpose of the present specification the term "cosmetic" and "cosmetics" must be understood as comprising one or more products that may be applied on any part of the body, preferably for beautifying the body, and the term "applicator" is any means such as a cotton-tipped rod, stick, brush, pad, a brush of hair or bristles, for applying a substance, such as a powder, paste, liquid or any other product capable of being applied onto the skin, lips, eyes, nails, or any other part of the body.

2. Description of the Prior Art

It is well known to provide several types of applicators, including multiple applicators for applying a variety of cosmetics to the body. The use of multiple applicators is being widely increased as long as more than one cosmetics and/or applicators are provided in only one cosmetics applying device.

There is two basic types of cosmetics applicators, one type consisting of a little box including a plurality of cosmetics arranged in corresponding pad-like sectors, like a painter's paddle, with a cotton-tipped rod, or a brush, and a mirror. Another type of applicator device comprises a pen-like applying device generally including a brush for applying a wet or dry powder cosmetic that is removed from a receptacle.

A very well known pen-like applicator of the above mentioned type comprises two parts, a first part being a cylindrical receptacle containing a dry or wet cosmetic, a mascara for example, and a second cylindrical part including a brush that is adapted to be inserted into the receptacle. When inserted into the receptacle, the brush remains in contact with the cosmetic contained within the receptacle, and the brush is adapted to be removed from the receptacle with cosmetic impregnated on the brush to apply the cosmetic on the body. This kind of applicator has only one cosmetic, such as the mascara, without any other cosmetic being provided in the container.

Another kind of pen-like applicator comprises a central holder having a brush at one end of the holder and a lining pencil at the opposite end of the holder. A receptacle containing a cosmetic is removably fixed to the end of the holder including the brush, whereby the brush remains within the receptacle, contacting the cosmetic, when the receptacle is fixed in the holder, and the brush is exposed for use when the receptacle is removed from the holder. A cap is also applied to the applicator and removably fixed to the end of the holder including the lining pencil, whereby the pencil remains protected by the cap when the cap is connected to the holder and the pencil is not in use and the pencil is exposed for use when the cap is removed from the holder. The pencil is permanently fixed to the holder by a rear end of the pencil that is firmly joined, by an adhesive for example, into a cavity of the holder. This pen-like applicator, however, requires the use of a cap for covering the lining pencil when the pencil is not in use, otherwise the marking tip of the pencil at the sharpened end of the pencil is exposed to extreme contacts with the environment, resulting in the occurrences of damages that causes the tip need to be re-sharpened to be in conditions to provide an acceptable marking and lining.

In order to protect the pencil tip it is therefore necessary to manufacture a cap that is provided of a threaded end or any other type of connecting means capable of removably fixing the cap to the holder. This is a time consuming and cost increasing part of the final product, not only as to its manufacturation is concerned but also in connection with its use. Thus, the cap is an additional part of the applicator that must be taken care of by the user when is removed from the holder.

It would be therefore convenient to have a new cosmetics applying device that provides the advantages of the known multiple applicators but having particular characteristics related to the manufacturation and use thereof as a result of the few component parts of the device which is also easy to use, without the need of removing and re-inserting a cap for protecting a lining applicator.

Summary of the Invention.

It is therefore one object of the present invention to provide a multiple pen-like cosmetics applying device comprising a central holder having a first end with a first applicator for application of a first cosmetic and a second end with a second applicator for applying a second cosmetic, the second applicator being removably mounted in the second end of the holder, whereby the second applicator can be moved between an operative position with an applicator tip of the second applicator being exposed for use and an inoperative position with the tip being housed in a cavity of the holder.

It is still another object of the present invention to provide a multiple pen-like cosmetics applying device comprising a central holder having a first end including a brush for applying wet or dry powder cosmetic and a second end including a lining pencil that is removably mounted in the second end, whereby the pencil is capable of being moved between an operative position with a marking tip of the pencil being exposed for use and an inoperative position with the tip being housed in a cavity of the holder.

It is a further object of the present invention to provide a cosmetics applying device comprising a holder having a first end and a second end, the first end including a first cosmetics applicator, a cap removably mounted in the first end of the holder to encircle the first cosmetics applicator when the cap is mounted on the holder, whereby the first cosmetics applicator remains housed and protected within the cap, the second end of the holder comprising retaining means for removably receiving a lining pencil, and a lining pencil having a leading end and a rear end, with a marking tip exposed at the leading end of the pencil, the pencil being movable between an operative position with the rear end firmly retained in the retaining means of the holder, and an unoperative position with the leading end of the pencil remaining housed and retained in the retaining means of the holder.

It is even another object of the present invention to provide a cosmetics applying device comprising a holder having a first end and a second end, the first end including a first cosmetics applicator, a cap removably mounted in the first end of the holder to encircle the first cosmetics applicator when the cap is mounted on the holder, whereby the first cosmetics applicator remains housed and protected within the cap, the second end of the holder comprising retaining means for removably receiving a second cosmetics applicator, and a second cosmetics applicator having a leading end and a rear end, with an applicator tip at the leading end of the second cosmetics applicator, the second cosmetics applicator being movable between an operative position with the rear end firmly retained in the retaining means of the holder, and an unoperative position with the leading end of the second cosmetics applicator remaining housed and retained in the retaining means of the holder.

Briefly, it is another object of the invention to provide a cosmetics applying device of the type described above with a brush at one end of the holder and a pencil at the opposite end of the holder. Alternatively, the brush may be replaced by a lipgloss stick and the lining pencil may be a lipliner.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
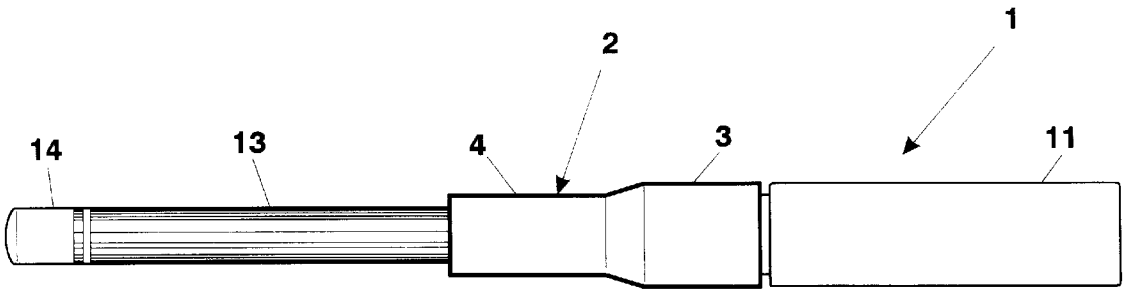
FIG. 1 shows a side view of multiple cosmetics applying device according to the invention, with all the parts of the device being assembled, thus in unoperative position.
Figure 2:
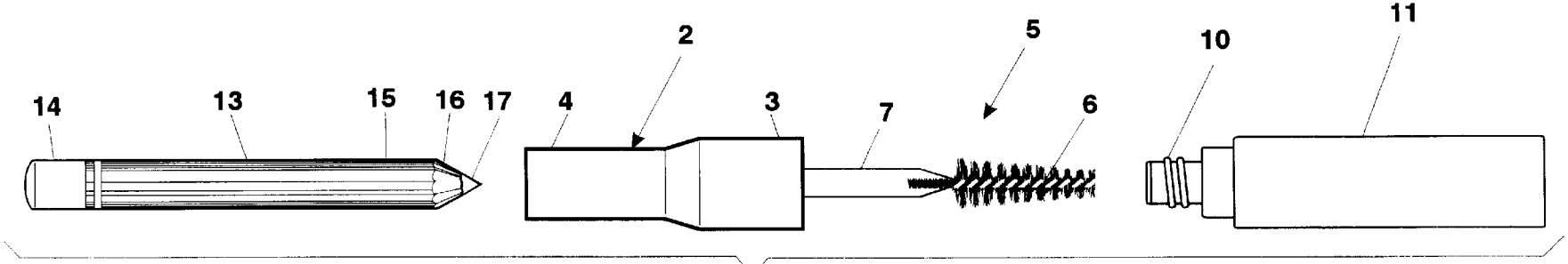
FIG. 2 shows an exploded view of the cosmetics applying device of FIG. 1.
Figure 6:
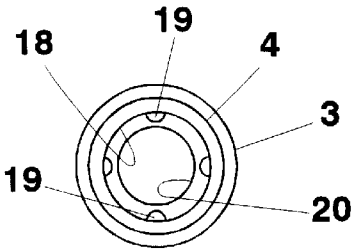
FIG. 6 is an end view of the second end of the holder, showing the cavity and the retaining means within the cavity of the holder.
Figure 3:
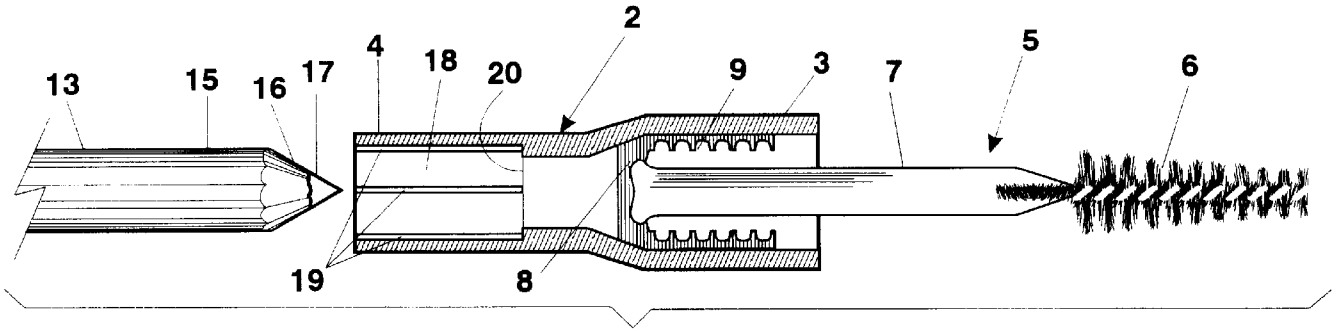
FIG. 3 shows an exploded partial cross-section view of the device of FIGS. 1 and 2 with the second cosmetic applicator removed from the holder and the cap for the first cosmetic applicator not illustrated for clarity purposes.

Now referring in detail to the drawings it may be seen from FIGS. 1–6 that the cosmetics applying device of the invention, generally indicated by numeral reference 1 in FIG. 1, comprises a central holder 2 having a first end 3 and a second end 4. Ends 3 and 4 are defined in opposite portions of the holder, the portions having different outer diameters, both portions being merged at a mid part of the holder by means of a slopped or conical mid portion. First end 3 includes a first cosmetic applicator 5 preferably comprising a brush 6 located at the tip or end portion of a stick 7 forming part of an integral insert 8 that is mounted within first end 3 of holder 2. Insert 8 comprises a plastic piece firmly retained within a cavity in end 3 of the holder, the insert including a threaded portion 9 to receive a complementary threaded end 10 of a cosmetic-containing cap 11, such as a container or receptacle that contains a predetermined quantity of cosmetic (not shown), such as a dry or a wet powder cosmetic, a mascara for example. The cosmetic is arranged within receptacle or container 11 in such a way that brush 6 is at least partially impregnated with the cosmetic when the cap is connected to the threaded portion 9 and mounted onto first end 3 of the holder. With the cap mounted or fixed to the holder, the first cosmetics applicator, consisting of brush 6 in this embodiment, is encircled by the cap and remains within cap 11, protected from the external environment and in contact with the cosmetic (not shown). To remove the cosmetic adhered in excess to the brush when the applicator is removed from the cap for using purposes, cap 11 may include, as it is well known in the art, a cosmetic removing scraper 12.

First cosmetics applicator 5 may comprise a brush as illustrated or any other type of applicator, such as a cotton-tipped stick or rod, a lipstick, a lipgloss applicator, etc.

A second cosmetic applicator 13 is provided at end 4 of the holder. Applicator 13 preferably comprises a lining pencil, such an eyeliner or a lipliner. Pencil 13 has a rear end 14 and a leading end 15, the leading end having a sharpened leading end 16 and a marking tip 17. The marking tip may be any lining cosmetic material, such as an eyeliner or a lipliner cosmetic. Pencil 13 may be made of any suitable material, but it is preferably a wood-made pencil.

Second end 4 of the holder includes a cavity 18, preferably a tubular cavity, comprising retaining means, such as longitudinal projecting ribs 19 (FIG. 6), for removably receiving and firmly retaining the lining pencil. Cavity 18 may alternatively have a size slightly smaller that the outer dimension of pencil 13 or may include some kind of friction enhancement means at an inner surface of the cavity to retain pencil 13 within cavity 18 when the pencil is inserted into the cavity. The retaining means should provide a retention force strong enough to firmly retain the pencil when is in use but weak enough to allow the user to remove the pencil once used.

Figure 4:
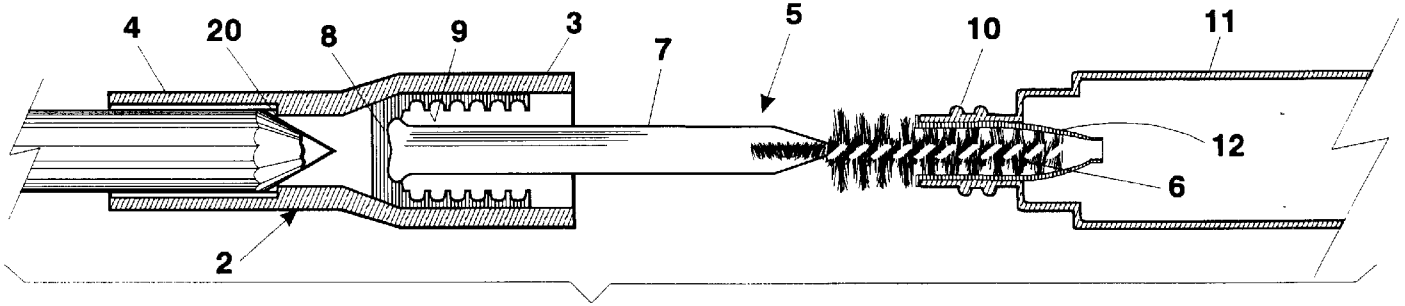
FIG. 4 shows an exploded partial cross-section view of the device of FIGS. 1 and 2 with the second cosmetic applicator inserted into the holder and the first cosmetic applicator partially within the corresponding cosmetic-containing cap.
Figure 5:
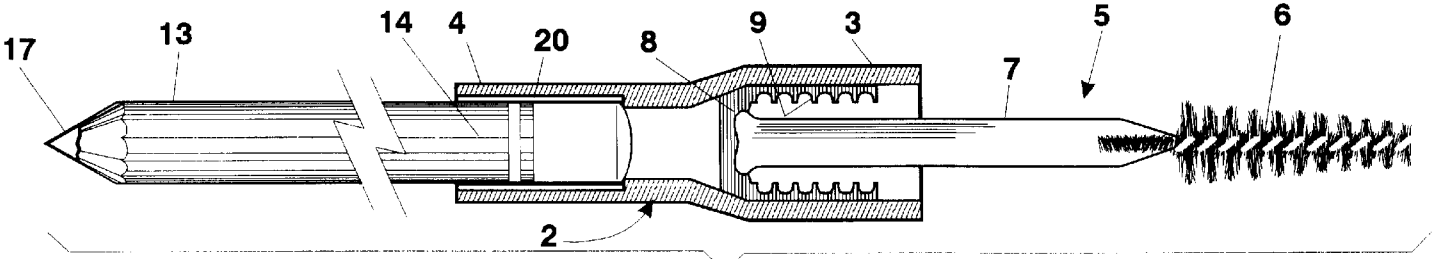
FIG. 5 shows a partial cross-section view, similar to FIGS. 3 and 4, of the device of the invention, with the rear end of second cosmetic applicator inserted into the holder, whereby the applicator is in the operative position.

Cavity 18 may receive either the leading end or the rear end of the pencil to retain the pencil within the cavity, whereby the pencil is movable between an operative position with the rear end 14 firmly retained in the holder, as it is shown in FIG. 5, and an unoperative position with leading end 15 of the pencil remaining housed and retained in the retaining means 19 of the holder, so that end 15 is protected from the environment, as it is shown in FIG. 4.

The holder preferably comprises a cylindrical holder and the cavity and the pencil have respective circular cross-sections. Other cross-sections, however, may be acceptable as long as there is a matching or coupling effect, preferably a friction coupling effect, between the pencil and the retaining means provided in cavity 18.

Cavity 18 is long enough to house sharpened end 16 and tip 17 of the pencil without the tip being in contact with the holder so as to prevent the tip from damaging. The cavity has also an abutting step 20 (FIG. 3–6) forming a stop for the sharpened leading end of the pencil when entering into the cavity (FIG. 4), thus protecting tip 17 and preventing the same from entering into contact with any part of the holder within the cavity. Step 20 may be formed by a restriction in an inner diameter of cavity 18, as illustrated, or may be devised by a flange inwardly projecting from the inner surface of cavity 18. Step 20 also acts to stop rear end 14 of the pencil, as it is shown in FIG. 5, so as to retain the pencil in a stable position during the use thereof.

While preferred embodiments of the present invention have been illustrated and described, it will be obvious to those skilled in the art that various changes and modifications may be made therein without departing from the scope of the invention as defined in the appended claims.

We claim:

1. A cosmetics applying device comprising:

a holder having a first end and a second end, the first end including a first cosmetics applicator for applying at least one cosmetic, a cap removably mounted in the first end of the holder to encircle the first cosmetics applicator when the cap is mounted on the holder, whereby the first cosmetics applicator remains housed and protected within the cap, the second end of the holder comprising retaining means for removably receiving a lining pencil, and a lining pencil having a leading end and a rear end, with a marking tip exposed at the leading end of the pencil, the pencil being movable between an operative position, with the rear end firmly retained in the retaining means of the holder, and an unoperative position, with the leading end of the pencil remaining housed and retained in the retaining means of the holder.

2. The cosmetics applying device of claim 1, wherein the first end of the holder includes an inner threaded portion for threadably receiving a threaded end of the cap.

3. The cosmetics applying device of claim 1, wherein the second end of the holder includes a tubular cavity for alternatively receiving the leading end or the rear end of the pencil, the cavity including an inner surface with a plurality of projecting longitudinal ribs for firmly retaining the pencil with the cavity either in the operative or in the unoperative position.

4. The cosmetics applying device of claim 3, wherein the holder is a cylindrical holder and the cavity and the pencil have respective circular cross-sections.

5. The cosmetics applying device of claim 1, wherein the second end of the holder includes a tubular cavity for alternatively receiving the leading end or the rear end of the pencil, the cavity including an inner surface with friction means for firmly retaining the pencil within the cavity either in the operative or in the unoperative position.

6. The cosmetics applying device of claim 5, wherein the holder is a cylindrical holder and the cavity and the pencil have respective circular cross-sections.

7. The cosmetics applying device of claim 1, wherein the applicator is a brush and the cap is a cosmetics-containing cap, whereby, when the cap is mounted on the first end of the holder, the brush is housed within the cap, in contact with the cosmetics.

8. The cosmetics applying device of claim 7, wherein the cosmetic is a mascara cosmetics.

9. The cosmetics applying device of claim 1, wherein the cosmetic is a lipgloss cosmetic and the applicator is a lipgloss applicator stick.

10. The cosmetics applying device of claim 1, wherein the pencil is an eyeliner pencil.

11. The cosmetics applying device of claim 1, wherein the pencil is a lipliner pencil.

12. The cosmetics applying device of claim 3, wherein the cavity is long enough to house the tip and a sharpened leading end of the pencil without the tip being in contact with the holder, thus protecting the tip against damages.

13. The cosmetics applying device of claim 12, wherein the cavity has an abutting step for stopping the sharpened leading end of the pencil when entering into the cavity to protect the tip of the leading end against damages by preventing the tip from entering into contact with any part of the holder within the cavity.

14. The cosmetics applying device of claim 5, wherein the cavity has an abutting step for stopping the leading end of the pencil when entering into the cavity to protect a sharpened leading end of the pencil and prevent the tip of the leading end from damage.

15. The cosmetics applying device of claim 9, wherein the pencil is a lipliner pencil.

16. The cosmetics applying device of claim 8, wherein the pencil is an eyeliner pencil.

17. A cosmetics applying device comprising:

a holder having a first end and a second end, the first end including a first cosmetics applicator, a cap removably mounted in the first end of the holder to encircle the first cosmetics applicator when the cap is mounted on the holder, whereby the first cosmetics applicator remains housed and protected within the cap, the second end of the holder comprising retaining means for removably receiving a second cosmetics applicator, and a second cosmetics applicator having a rear end and a leading end including an applicator tip, the second cosmetics applicator being movable between an operative position with the rear end firmly retained in the retaining means of the holder, and an unoperative position with the leading end of the second cosmetics applicator remaining housed and retained in the retaining means of the holder.

18. The cosmetics applying device of claim 17, wherein the second end of the holder includes a tubular cavity for alternatively receiving the leading end or the rear end of the second cosmetics applicator, the cavity including an inner surface with a plurality of projecting longitudinal ribs for firmly retaining the second cosmetics applicator within the cavity either in the operative or in the unoperative position.

19. The cosmetics applying device of claim 18, wherein the cavity is long enough to house the tip of the second cosmetics applicator without the tip being in contact with the holder, thus protecting the tip against damages.

20. The cosmetics applying device of claim 19, wherein the cavity has an abutting step for stopping the leading end of the second cosmetics applicator when entering into the cavity to protect the tip of the leading end against damages by preventing the tip from entering into contact with any part of the holder within the cavity.

* * * * *